US006095605A

United States Patent [19]

Lai

[11] Patent Number: 6,095,605

[45] Date of Patent: Aug. 1, 2000

[54] BACKREST ADJUSTING DEVICE

[76] Inventor: Yu-shan Lai, 4F-3, No. 228, Zhi You Rd., Jia Yi City, Taiwan

[21] Appl. No.: 09/338,665

[22] Filed: Jun. 22, 1999

[51] Int. Cl.[7] ..... A47C 7/46

[52] U.S. Cl. ..... 297/284.4; 297/284.2; 74/502.4; 74/502.6; 74/502

[58] Field of Search ..... 297/284.4, 284.2, 297/284.7, 284.8; 74/502.4, 502.6, 502, 501.5 R, 500.5

[56] References Cited

U.S. PATENT DOCUMENTS

| | | | |
|---|---|---|---|
| 5,217,278 | 6/1993 | Harrison et al. | 297/284.4 |
| 5,716,098 | 2/1998 | Lance | 297/284.2 |
| 5,797,652 | 8/1998 | Darbyshire | 297/284.4 |
| 5,954,399 | 9/1999 | Hong | 297/284.4 |

*Primary Examiner*—Anthony D. Barfield
*Attorney, Agent, or Firm*—Alan Kamrath; Oppenheimer Wolff & Donnelly LLP

[57] ABSTRACT

A backrest adjusting device is disposed in a backrest pad. The backrest adjusting device has a main body, a screw rod, a block, an adjustment button, a pin, a tube, and a flexible plate. The main body has a hollow interior, a round aperture, a circular aperture, a through hole, and a sleeve. The screw rod has a threaded hole, an annular recess, and a distal portion. The block has a groove and a threaded portion. The adjustment button and the screw rod are fastened together. The tube is connected to the sleeve. The screw rod and the block are inserted in the hollow interior. The distal portion of the screw rod is inserted in the round aperture. A plug is inserted in the groove. The flexible plate has an extension pipe and an oblong hole. A wire is connected to the plug and the flexible plate.

1 Claim, 7 Drawing Sheets

BACKREST ADJUSTING DEVICE

BACKGROUND OF THE INVENTION

The present invention relates to a backrest adjusting device. More particularly, the present invention relates to a backrest adjusting device of a chair.

A conventional chair has a fixed backrest. Another conventional chair has an adjustable backrest. However, it is difficult to operate the adjustable backrest.

SUMMARY OF THE INVENTION

An object of the present invention is to provide a backrest adjusting device which can be operated easily.

Accordingly, a backrest adjusting device is disposed in a backrest pad. The backrest adjusting device comprises a main body, a screw rod, a block, an adjustment button, a pin, a tube, and a flexible plate. The main body has four lugs, a hollow interior, a round aperture communicating with the hollow interior, a circular aperture communicating with the hollow interior, a through hole, and a sleeve disposed on the main body and communicating with the circular aperture. The screw rod has a threaded hole, an annular recess, and a distal portion. The block has a groove and a threaded portion engaging with the screw rod. The adjustment button has a center hole. The tube is connected to the sleeve. The screw rod and the block are inserted in the hollow interior. The distal portion of the screw rod is inserted in the round aperture. A plug is inserted in the groove. The lugs are fastened in the backrest pad. The flexible plate has an extension pipe and an oblong hole. A pin passes through the through hole. The pin is inserted in the annular recess. A bolt fastens the adjustment button and the screw rod together via the center hole and the threaded hole. A wire is connected to the plug and the flexible plate. An end of the wire is inserted in the oblong hole. The wire passes through the extension pipe, the sleeve, and the circular aperture. When the adjustment button is rotated clockwise, the screw rod is rotated clockwise also. Then the block moves downward. Therefore, the flexible plate becomes even. When the adjustment button is rotated counterclockwise, the screw rod is rotated counterclockwise also. Then the block moves upward. Therefore, the flexible plate becomes bent.

DETAILED DESCRIPTION OF THE INVENTION

Figure 1:
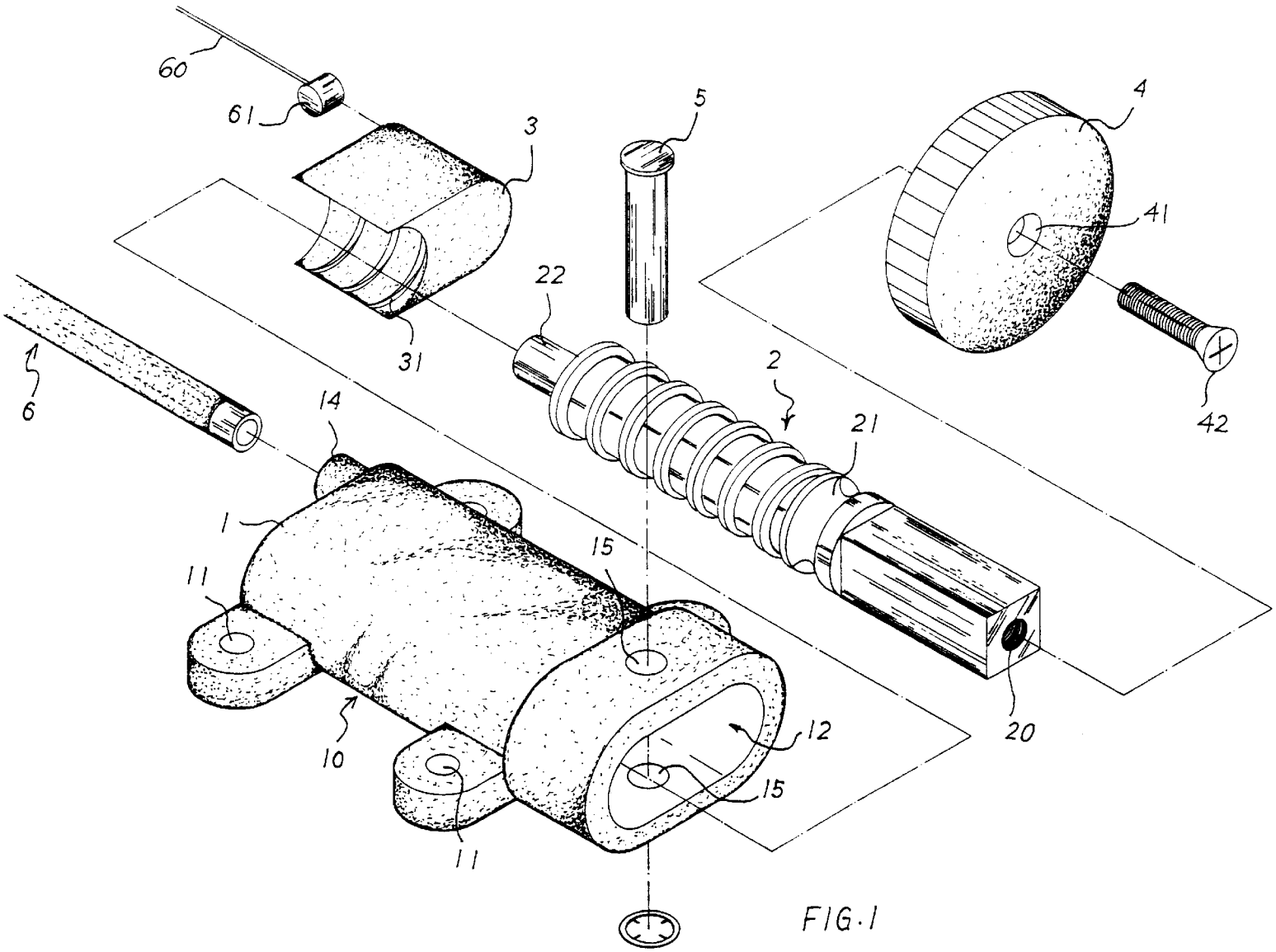
FIG. 1 is a perspective exploded view of a backrest adjusting device of a preferred embodiment in accordance with the present invention.
Figure 2:
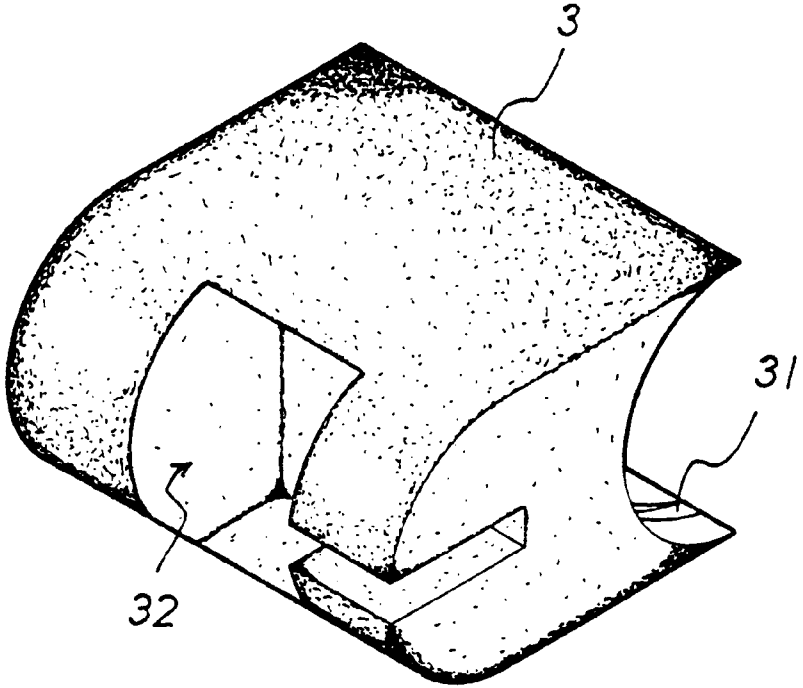
FIG. 2 is a perspective view of a block of a preferred embodiment in accordance with the present invention.
Figure 3:
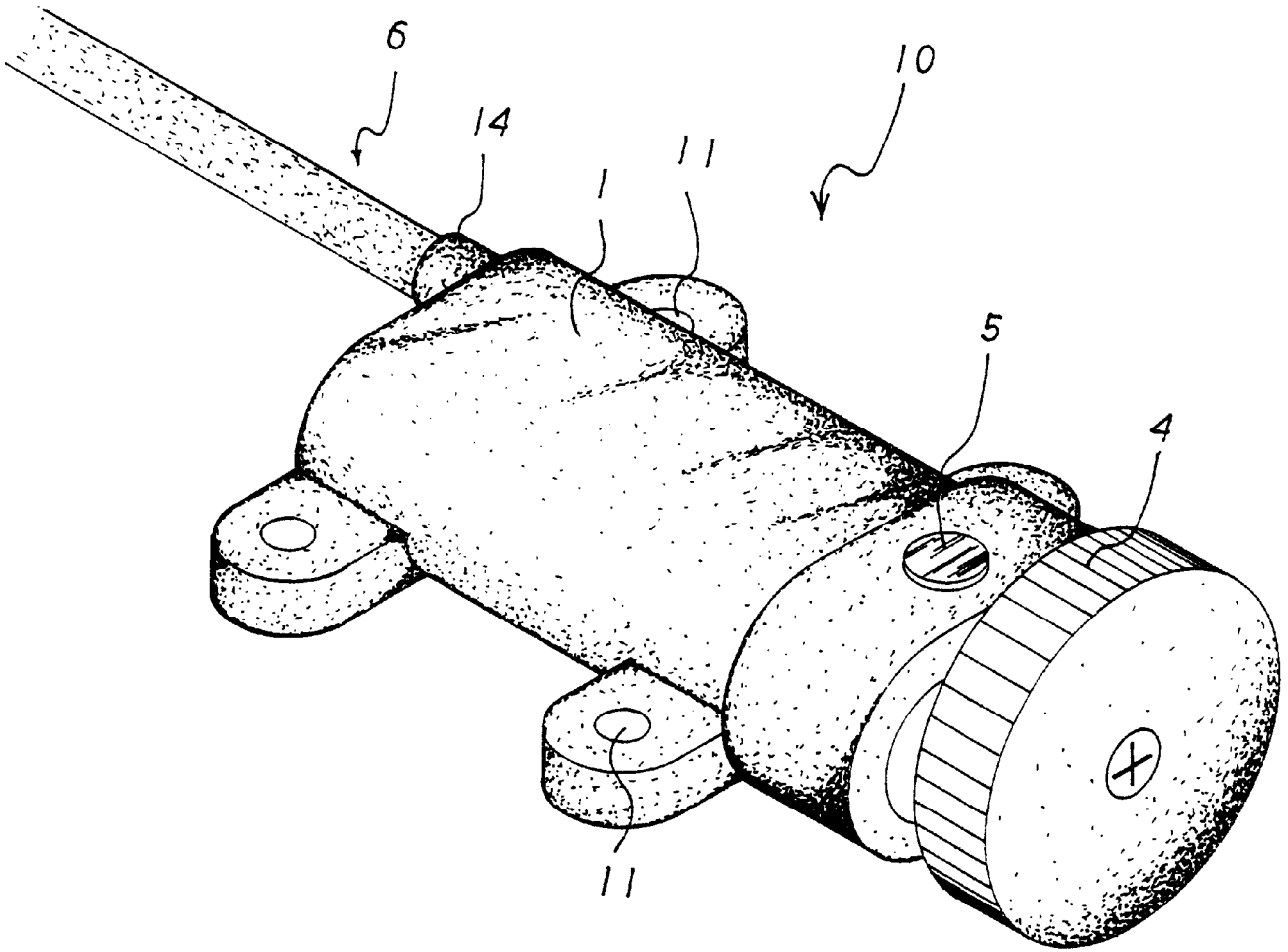
FIG. 3 is a perspective assembly view of a backrest adjusting device of a preferred embodiment in accordance with the present invention.
Figure 4:
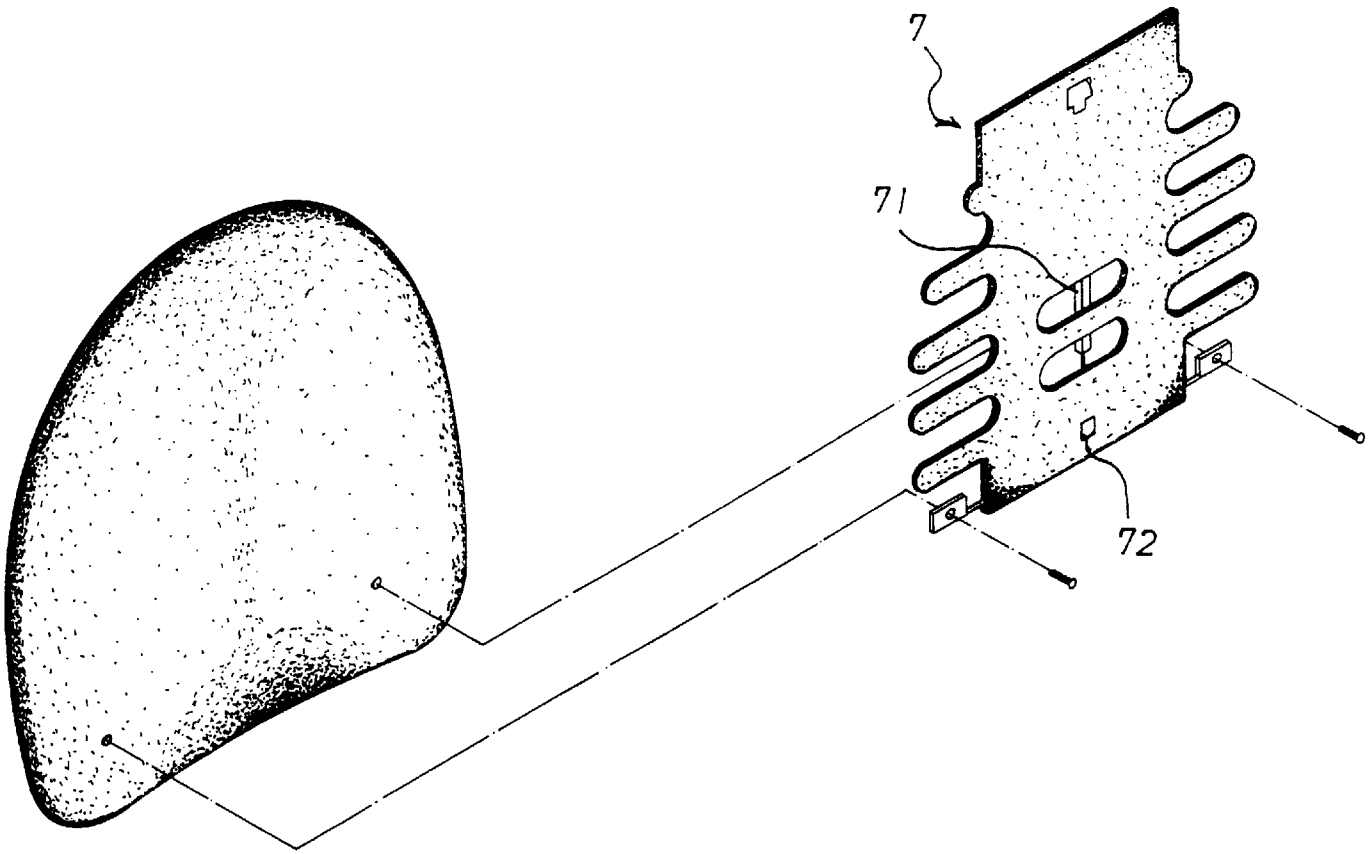
FIG. 4 is a perspective view of a backrest pad of a preferred embodiment in accordance with the present invention.
Figure 5:
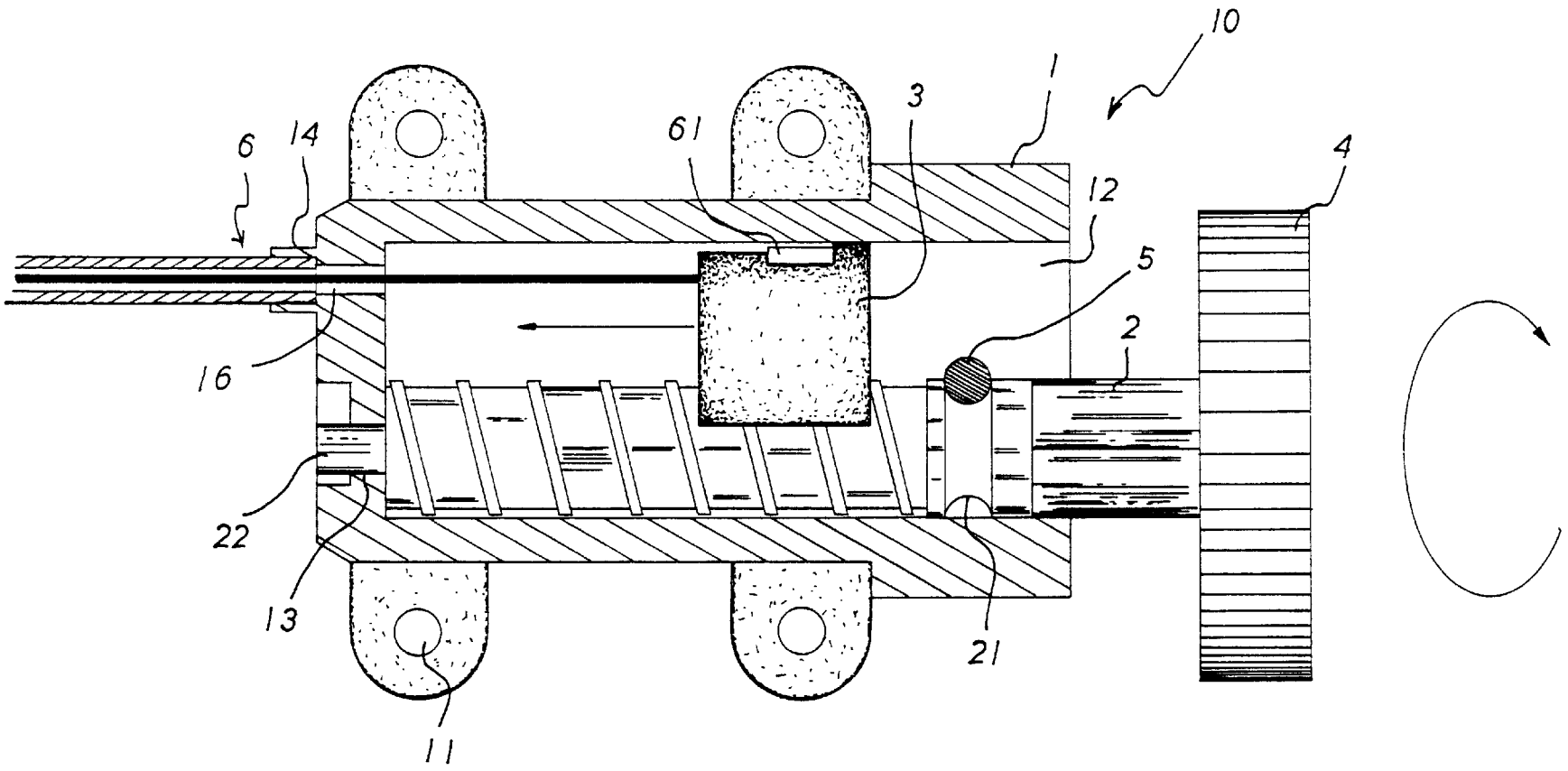
FIG. 5 is a schematic view illustrating an operation of a backrest adjusting device of a preferred embodiment in accordance with the present invention.
Figure 6:
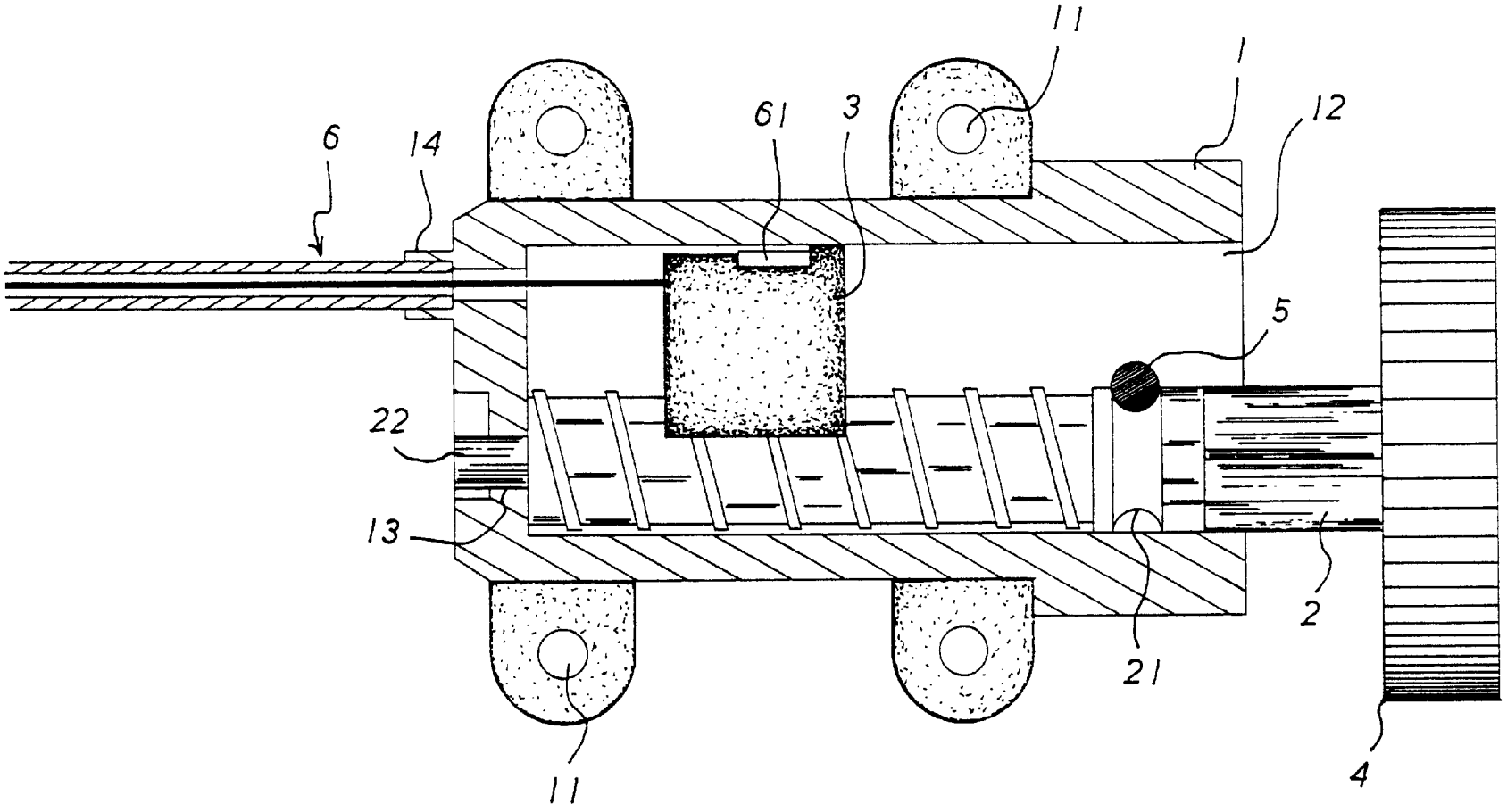
FIG. 6 is another schematic view illustrating an operation of a backrest adjusting device of a preferred embodiment in accordance with the present invention.
Figure 7:
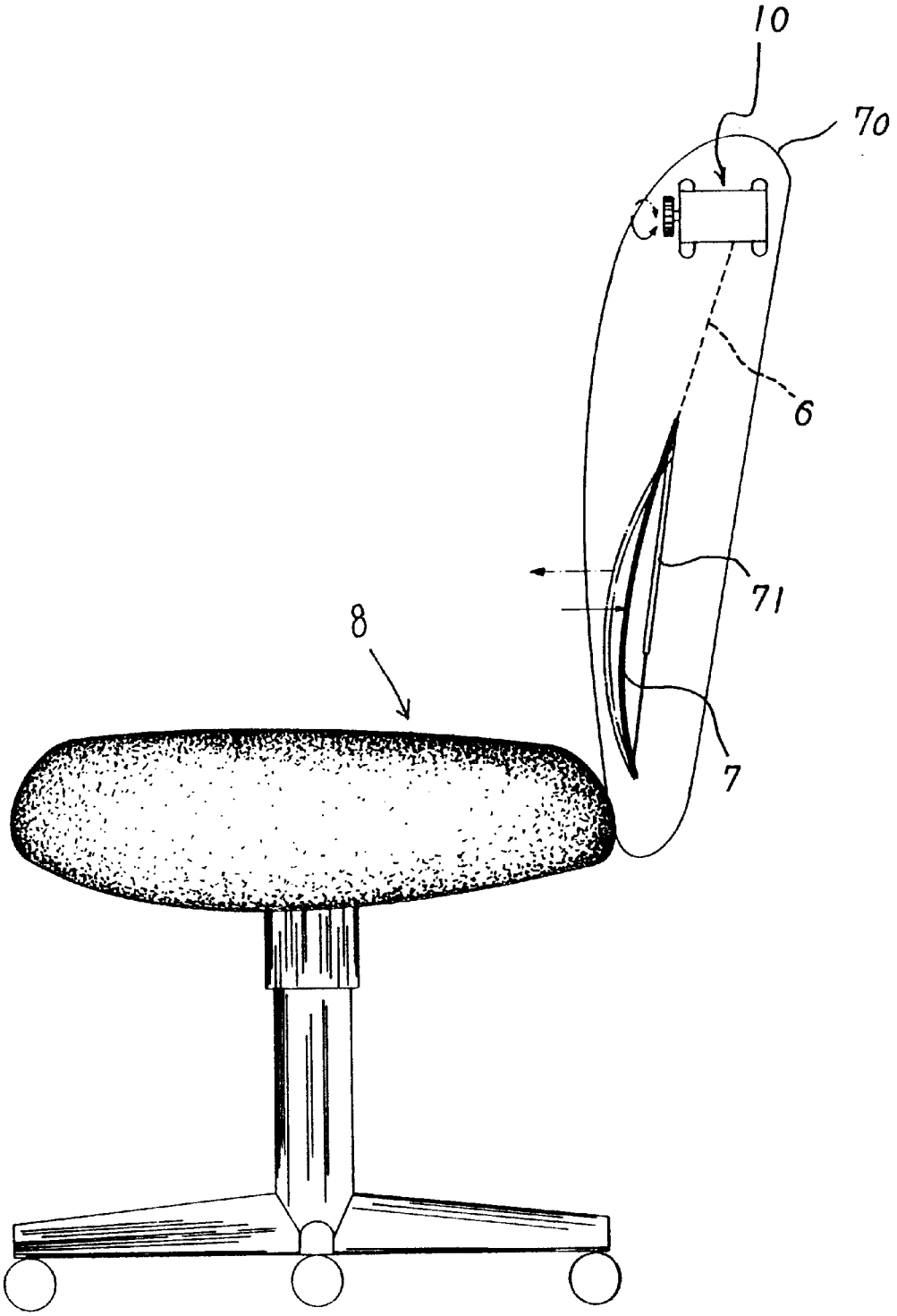
FIG. 7 is a schematic view illustrating a backrest pad of a preferred embodiment disposed on a chair seat.

Referring to FIGS. 1 to 7, a backrest adjusting device 10 is disposed in a backrest pad 70. The backrest pad 70 is disposed on a chair seat 8.

The backrest adjusting device 10 comprises a main body 1, a screw rod 2, a block 3, an adjustment button 4, a pin 5, a tube 6, and a flexible plate 7.

The main body 1 has four lugs 11, a hollow interior 12, a round aperture 13 communicating with the hollow interior 12, a circular aperture 16 communicating with the hollow interior 12, a through hole 15, and a sleeve 14 disposed on the main body 1 and communicating with the circular aperture 16.

The screw rod 2 has a threaded hole 20, an annular recess 21, and a distal portion 22.

The block 3 has a groove 32 and a threaded portion 31 engaging with the screw rod 2.

The adjustment button 4 has a center hole 41.

The tube 6 is connected to the sleeve 14.

The screw rod 2 and the block 3 are inserted in the hollow interior 12. The distal portion 22 of the screw rod 2 is inserted in the round aperture 13. A plug 61 is inserted in the groove 32.

The lugs 11 are fastened in the backrest pad 70.

The flexible plate 7 has an extension pipe 71 and an oblong hole 72.

A pin 5 passes through the through hole 15. The pin 5 is inserted in the annular recess 21.

A bolt 42 fastens the adjustment button 4 and the screw rod 2 together via the center hole 41 and the threaded hole 20.

A wire 60 is connected to the plug 61 and the flexible plate 7. An end of the wire 60 is inserted in the oblong hole 72. The wire 60 passes through the extension pipe 71, the sleeve 14, and the circular aperture 16.

When the adjustment button 4 is rotated clockwise, the screw rod 2 is rotated clockwise also. Then the block 3 moves downward. Therefore, the flexible plate 7 becomes even.

When the adjustment button 4 is rotated counterclockwise, the screw rod 2 is rotated counterclockwise also. Then the block 3 moves upward. Therefore, the flexible plate 7 becomes bent.

The present invention is not limited to the above embodiment but various modification thereof may be made. Furthermore, various changes in form and detail may be made without departing from the scope of the present invention.

I claim:

1. A backrest adjusting device disposed in a backrest pad, the backrest adjusting device comprising a main body, a screw rod, a block, an adjustment button, a pin, a tube, and a flexible plate, characterized in that:

the main body has four lugs, a hollow interior, a round aperture communicating with the hollow interior, a circular aperture communicating with the hollow interior, a through hole, and a sleeve disposed on the main body and communicating with the circular aperture, the screw rod having a threaded hole, an annular recess, and a distal portion, the block having a groove and a threaded portion engaging with the screw rod, the adjustment button has a center hole, the tube is connected to the sleeve, the screw rod and the block are inserted in the hollow interior, the distal portion of the screw rod is inserted in the round aperture, a plug is inserted in the groove, the lugs are fastened in the backrest pad, the flexible plate has an extension pipe and an oblong hole, the pin passes through the through hole, the pin is inserted in the annular recess, a bolt fastens the adjustment button and the screw rod together via the center hole and the threaded hole, a wire is connected to the plug and the flexible plate, an end of the wire is inserted in the oblong hole, and the wire passes through the extension pipe, the sleeve, and the circular aperture, when the adjustment button is rotated clockwise, the screw rod is rotated clockwise and the block moves downward, when the adjustment button is rotated counterclockwise, the screw rod is rotated counterclockwise and the block moves upward.

* * * * *